US007095335B2

(12) United States Patent
De Bolster et al.

(10) Patent No.: US 7,095,335 B2
(45) Date of Patent: Aug. 22, 2006

(54) ARRANGEMENT INCLUDING A REMOTE CONTROL DEVICE AND A FIRST ELECTRONIC DEVICE

(75) Inventors: Ann De Bolster, Leuven (BE); Marc Emiel Celine Lambrechts, Leuven (BE); Johan Agnes Emile Wouters, Leuven (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 884 days.

(21) Appl. No.: 09/989,244

(22) Filed: Nov. 20, 2001

(65) Prior Publication Data

US 2002/0101358 A1 Aug. 1, 2002

(30) Foreign Application Priority Data

Nov. 23, 2000 (EP) ..... 00204165

(51) Int. Cl.
*G08C 19/00* (2006.01)

(52) U.S. Cl. ..... 340/825.72; 340/825.69; 340/825.22; 340/3.31; 340/3.32; 340/426.13; 340/5.74; 341/176; 341/173

(58) Field of Classification Search ..... 340/825.22, 340/825.72, 825.69, 426.13, 3.31, 3.32; 341/176, 341/173; 348/734, 14.05; 359/142; 379/369; 700/17

See application file for complete search history.

(56) References Cited

U.S. PATENT DOCUMENTS 6,104,334 A 8/2000 Allport ..... 341/175
6,130,625 A * 10/2000 Harvey ..... 340/825.72
6,133,847 A * 10/2000 Yang ..... 340/825.22
6,160,491 A * 12/2000 Kitao et al. ..... 340/825.69
6,309,275 B1 * 10/2001 Fong et al. ..... 446/297
6,574,798 B1 * 6/2003 Bradley et al. ..... 725/153

* cited by examiner

*Primary Examiner*—Wendy R. Garber
*Assistant Examiner*—Vernal Brown

(57) ABSTRACT

In an arrangement including a remote control device and at least a first electronic device, the remote control device includes a first memory for storing a set of code data for controlling a further electronic device, the first memory being connected to an input of a signal generator for supplying the code data to the input, the signal generator generating, on the basis of the code data, control signals for controlling the further electronic device, and transmitting these control signals to the further electronic device. The first electronic device includes a data input for receiving data from the remote control device, and the remote control device includes a code data output unit connected to the first memory. The code data output unit has a further input for receiving an upload signal and reads, under control of the upload signal, at least a subset of the set of code data from the first memory. The code data output unit transmits the subset of code data burst-wise to the data input of the first electronic device, and first electronic device includes a second memory for storing a received subset of code data.

7 Claims, 4 Drawing Sheets

ARRANGEMENT INCLUDING A REMOTE CONTROL DEVICE AND A FIRST ELECTRONIC DEVICE

BACKGROUND OF THE INVENTION

1. Field of the Invention

The invention relates to an arrangement including a remote control device and at least a first electronic device, said remote control device having a first memory for storing a set of code data for controlling a further electronic device, the first memory being connected to an input of a signal generator for supplying said code data to said input, the signal generator being adapted to generate, on the basis of said code data, control signals for controlling said further electronic device, and to transmit said control signals to said further electronic device, said first electronic device having a data input arranged to receive data from said remote control device.

2. Description of the Related Art

Such arrangements are generally known from audio and video apparatuses. In the known arrangements, the remote control device has a first memory which is loaded with code data retrieved from, for example, a smart card. Once the code data has been retrieved from the smart card and loaded into the first memory, the smart card may be disposed of. To control the further electronic device, the user presses or touches a key of the remote control device, which causes the code data assigned to the selected key to be retrieved from the first memory. The retrieved code data is supplied to the signal generator, which generates a control signal based on the retrieved code data. The generated signal is then transmitted to the electronic device to control the latter.

A drawback of the known arrangement is that the generation of a backup of the code data is rather laborious. A user who wishes to generate a backup version of the code data is obliged to retrieve them one by one from the first memory by, each time, pressing or touching the assigned key. Such an operation is time-consuming and there is a fair chance that the user will omit to press certain keys, which results in an incomplete backup. Moreover, it is the control signal and not the code data as such that is transmitted.

SUMMARY OF THE INVENTION

It is an object of the present invention to provide a more user-friendly way of generating a backup version of the code data.

An arrangement according to the invention is characterized in that said remote control device has a code data output unit connected to said first memory, said code data output unit having a further input for receiving an upload signal and being adapted to read, under control of said upload signal, at least a subset of said set of code data from said memory, said code data output unit being further adapted to transmit said subset burst-wise to said data input of said first electronic device, said first electronic device including a second memory for storing a received subset. By including a code data output unit in the remote control device and a second memory in the first electronic device, the code data as such can be retrieved from the first memory and transmitted to the second memory as code data in order to be stored in this second memory. In this way, at least a second subset of the code data is available not only in the first memory but also in the second memory, which belongs to the first electronic device. Thus, when the code data in the remote control device is lost, for example, due to a battery failure, the code data can be downloaded from the second memory and there is no need to buy a new smart card. Moreover, by sending the code data subset burst-wise to the first electronic device, it is no longer necessary to send and retrieve them by pressing one key after the other on the remote control device.

A first preferred embodiment of an arrangement according to the invention is characterized in that said signal generator is connected to said code data output unit, said code data output unit being adapted to generate a control signal after reading of said subset and to transmit said control signal and said subset to said signal generator, said signal generator being adapted to generate a code data signal, which includes said subset, upon receipt of said control signal and to transmit said code data signal to said data input of the first electronic device, said first electronic device including a signal decoder adapted to retrieve said subset from a received code data signal. In this way, the transmission of the subset to the second memory is effected by means of the signal generator without the transmission of the control signals or the operation of the further electronic device being affected.

A second preferred embodiment of an arrangement according to the invention is characterized in that said first electronic device includes a verification unit connected to said data input, said verification unit being adapted to compare a received subset with subsets stored in said second memory and to generate a first flag if said received subset is not stored in said second memory. The presence of a verification unit makes it possible to verify whether the newly supplied subset has already been received by the first electronic device.

A third preferred embodiment of an arrangement according to the invention is characterized in that said verification unit is adapted to generate a second flag if said received subset is already stored in said second memory, said verification unit being further adapted to inhibit, under control of said second flag, the storage of said received subset in said second memory. Thus, it is achieved that only subsets which are not yet stored in the second memory will be stored.

Preferably, said signal generator is adapted to generate said control signal in accordance with a predetermined transmission protocol, said code data output unit being adapted to include an identifier, which identifies said transmission protocol, into said subset. When a universal remote control device is used, the identifier makes it possible to add the protocol to the code data and to furnish the protocol upon loading of a subset retrieved from the second memory.

The invention also relates to a remote control device forming part of said arrangement.

Preferably, said remote control device is a user-configurable remote control device. Since user-configurable remote control devices have volatile memories, the present invention offers a suitable solution to load or update them directly from the first electronic device without use of a smart card.

BRIEF DESCRIPTION OF THE DRAWINGS

The invention will now be described in more detail with reference to the drawings, which show a preferred embodiment of a communication system according to the invention. In the drawings.

DESCRIPTION OF THE PREFERRED EMBODIMENTS

Figure 1:
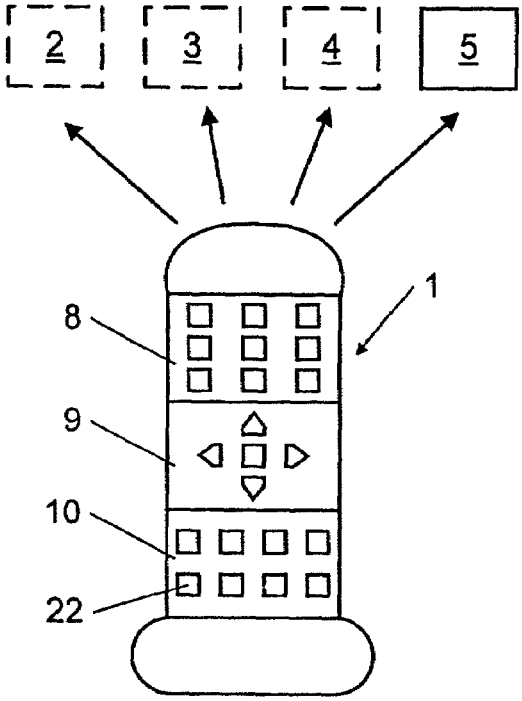
FIGS. 1 and 2 illustrate, schematically, an arrangement according to the invention.

In the drawings, the same or similar elements bear the same reference signs. The arrangement illustrated in FIG. 1 comprises a remote control device 1 and at least one further electronic device 2, 3, 4 and 5. The number of electronic devices shown in FIG. 1 is of course arbitrary and the arrangement may include more or less devices than the four illustrated. The devices are formed by, for example, a television receiver 2, a video recorder 3, an audio amplifier 4 and a set-top box 5. In the following description, the first electronic device is, for example, the set-top box 5. The remote control is adapted to send control signals to the electronic devices 2, 3 and 4, and to communicate with the first electronic device 5.

The remote control device 1 has several command keys 8, 9 and 10, which are either formed by resilient push buttons or by soft keys displayed on a display screen. Activation of one of the keys initiates the generation of a control signal which is transmitted to the relevant device in order to control this device.

The remote control device 1 may be a user-configurable remote control device which can be loaded either by a smart card or by other means, such as direct connection to a database. However, it will be evident that the present invention is not limited to a user-configurable remote control device.

Figure 2:
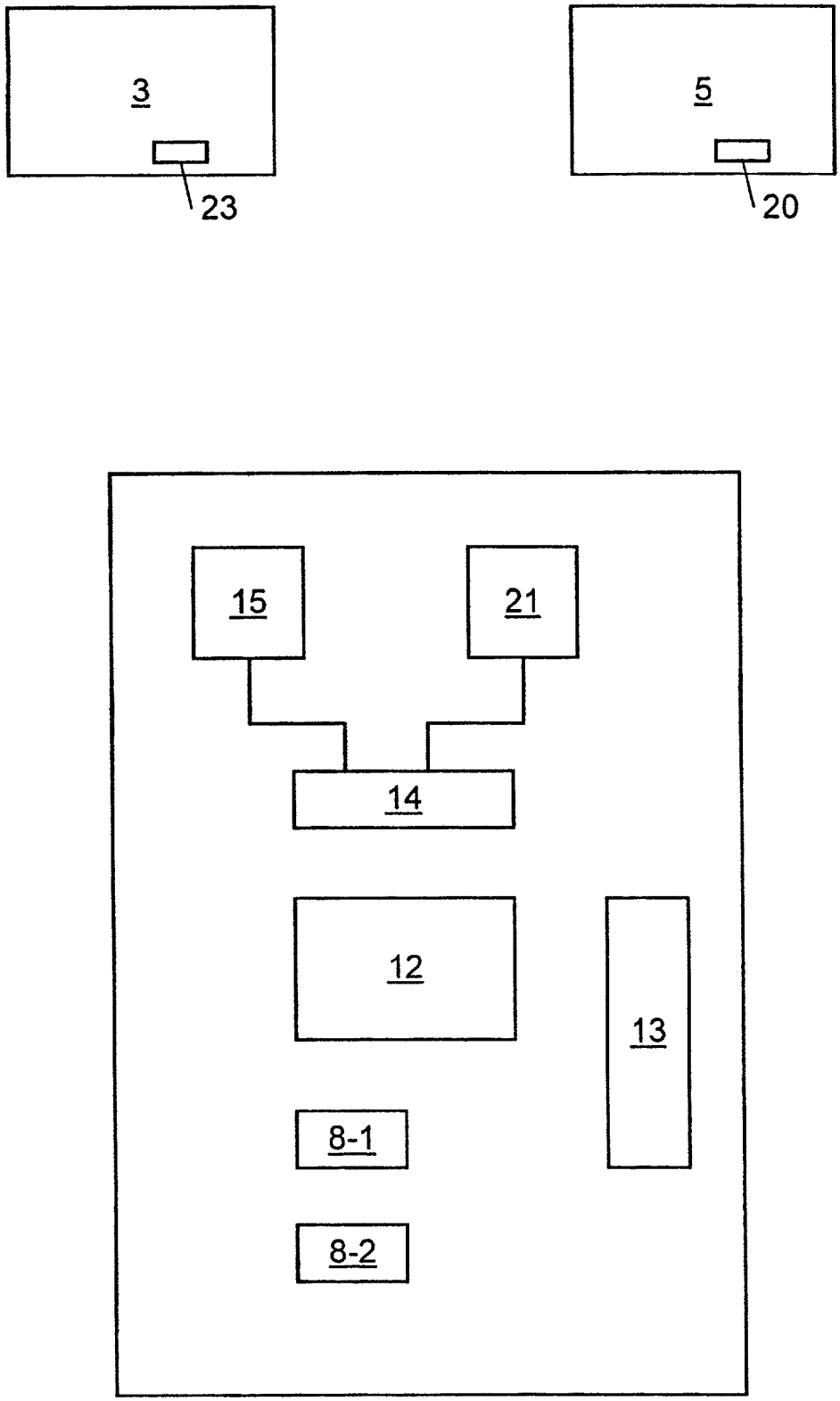

As illustrated in FIG. 2, the first electronic device 5 has a data input 20 for receiving data from the remote control device 1. The further device 3 has a control signal input 23 for receiving control signals from the remote control device 1. For this purpose, the remote control device 1 includes a transmitter 15. The remote control device further includes a code data output unit 21 and a first memory 13 connected to a data processing unit 12.

Figure 3:
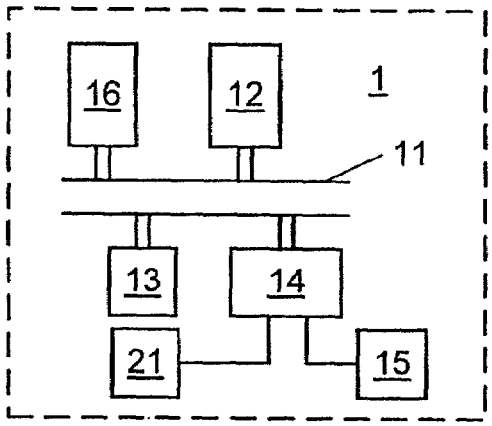
FIGS. 3 and 4 illustrate, schematically, an electronic circuit of the remote control device and of the first electronic device, respectively.

FIG. 3 is a block diagram which schematically shows the electronic circuit of the remote control device 1. The remote control device 1 includes a communication bus 11, to which the data processing unit 12, for example, a microprocessor, is connected. The first memory 13 and a key module 16, as well as an interface 14, are also connected to the bus 11. The key module 16 forms the interface between the command keys 8, 9 and 10 and the processing unit 12 and converts the actuation of a key into an instruction to be processed by the data processing unit 12. The first memory 13 serves for storing a set of code data for controlling at least one further electronic device (2, 3, 4). The interface 14 is further connected to a second communication unit 15, preferably an infrared transmitter, for transmitting signals to the electronic devices, and to the code data output unit 21.

Upon activation of one of the keys by a user, for example, a key 8-1 "Volume up", the key module 16 transmits an instruction identifying the activated key to the data processing unit 12. On the basis of this instruction, the data processing unit 12 generates an address for the first memory 13 and reads out the code data assigned to the activated key. The code data thus read is then transferred to the interface 14, which includes a signal generator for generating, on the basis of the supplied code data, a control signal for controlling one of the further electronic devices. The control signal is sent to the further electronic device by means of the transmitter 15.

Each of the further electronic devices is adapted to detect a control signal emitted by the remote control device. The control signal is, therefore, usually modulated on a carrier wave in accordance with a predetermined transmission protocol, to which the electronic device is responsive. The signal generator of the interface 14 modulates the code data on the carrier wave depending on the electronic device for which the signal is intended. The signal is also modulated in accordance with the protocol of the addressed electronic device. If the remote control device 1 is a user-configurable universal remote control device, it is necessary to supply the necessary data, including the transmission protocol and the carrier wave frequency to the signal generator, in order to generate a control signal that can be received and decoded by the addressed electronic device. Therefore, it is important to store not only the code data assigned to each of the keys, for example, to increase the sound volume of the television receiver, but also the carrier frequency and the modulation protocol. Instead of by means of a carrier frequency, the control signal could be formed by means of a series of pulses, wherein either the number or the length of the pulses determines the contents of the control signal.

Figure 4:
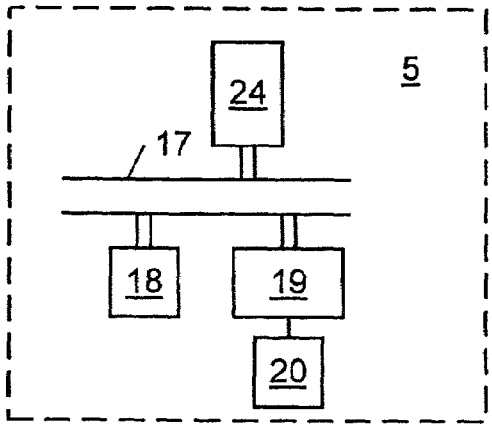

FIG. 4 is a block diagram which schematically shows the electronic circuit of the first electronic device 5. The first electronic device has a communication bus 17, to which a data processing unit 24 and a second memory 18 are connected. An interface 19 is also connected to bus 17. The data input 20 is connected to the interface 19. This data input 20 serves to receive code data from the remote control device 1. It should be noted that the first electronic device may also be formed by a conventional PC in connection with the Internet or by a television or audio receiver connected to a Cable Antenna TV system (CATV). In the latter cases, the second memory 18 is formed by the RAM of the PC or by a buffer capable of storing, at least temporarily, data downloaded from the Internet or from the CATV supplier. It is not necessary that the data input 20 and the second memory are physically connected to the same bus 17. They could be remote from each other. However, it is important that they can communicate with each other.

Figure 5:
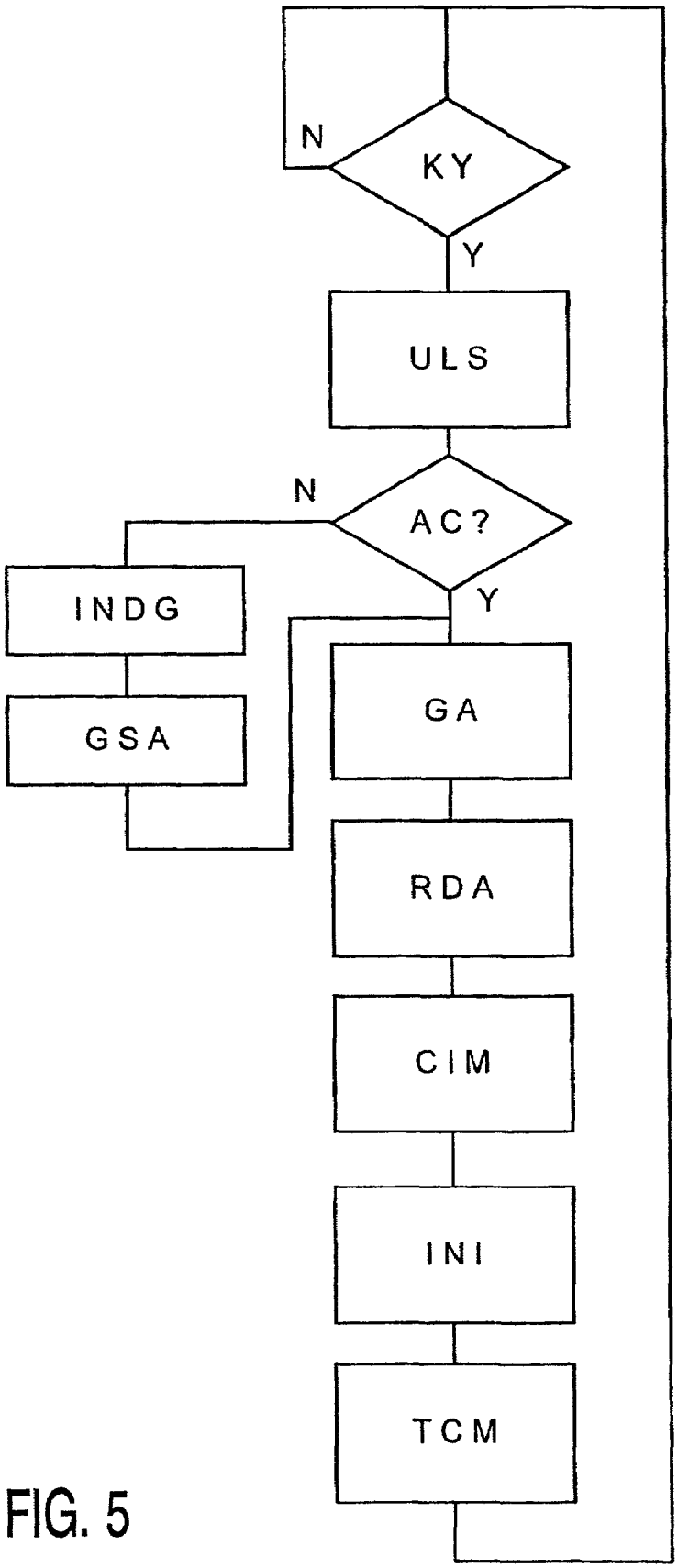
FIG. 5 shows a flowchart illustrating the operation of the remote control device when code data is to be transmitted.

The second memory 18 of the first electronic device 5 serves for storing code data originating from the first memory 13 of the remote control device 1. In order to transfer the code data assigned to each of the command keys, the remote control device 1 should be switched to an upload mode. For this purpose, the user presses, for example, a key 22 on the remote control device 1. Alternatively, the user may press another key, for example, the volume up key, twice or three times or press two keys successively depending on how the remote control device is constructed. By pressing (KY) the appropriate key or keys, an upload signal is generated (ULS) as illustrated schematically in the flowchart shown in FIG. 5. The different instructions illustrated in this flowchart are executed under control of the data processing unit 12.

The upload signal is supplied to the code data output unit 21 in order to activate the latter, and the data processing unit 12 requests (AC) the user if all the code data should be read from the first memory. This is realized, for example, by displaying a message on a display of the remote control device 1, or by making keys light up. When the user indicates that not all the code data but only a subset of the code data set (AC:N) should be selected, the data processing unit 12 requests the user (IND G) to indicate which subset should be selected. Thus the user may request, for example, that only the code data for controlling the VCR be selected. The user then indicates (GSA) which subset should be selected, for example, by pressing the key associated with the selected device.

Once the user has indicated which code data should be selected, the code data output unit receives the user's instructions, i.e., either all code data or only a selected subset, and starts to generate (GA) the addresses of the first memory locations where the selected code data are stored. The generated addresses are then supplied to the first memory in order to read and retrieve (RDA) the code data stored at the addressed memory locations.

Depending on the configuration of remote control device and the first electronic device, the read code data is then configured into a transmittable message (CTM). For example, in the case that the remote control device and the first electronic device can be connected by means of a wire, the code data is digitally transferred in a manner similar to that in which data is transmitted in a computer network. If, on the other hand, the code data is transmitted by means of an infra-red or ultrasonic signal, the code data is modulated as a series of pulses. However, these pulses differ from those used to transfer a control signal, in order to not disturb the operation of the other electronic devices. The signal generator could be used for transmitting the code data. However, the signal generator is then switched to a mode suitable to transmit such code, for example, by means of a control signal generated by the code data output unit.

If the signal generator is adapted to generate control signals in accordance with a predetermined transmission protocol, for example, RC 5 for Philips devices, this protocol may also be included in the data transmitted to the first electronic device. In the latter case, the code data output unit generates an identifier, which identifies this protocol, and includes (INI) this identifier into the subset of code data to be transmitted. This is, in particular, the case if a learning or user-configurable remote control device is used to control several electronic devices from different manufacturers. For each electronic device, the transmission protocol has to be identified and entered into the learning remote control device.

Once the message includes the code data, with or without the identifier, this code data signal is transmitted (TCM) to the first electronic device.

The code data is transmitted burst-wise to the first electronic device either as a batch including all the code data to be transferred or as a series of successive signals. Once the code data, with or without the identifier, are received by the first electronic unit, said data can be stored in the second memory 18. If the data input is used to receive the code data signal, the data input is preferably received from a signal decoder adapted to retrieve the subset and the identifier, if present, from the received code data signal. The retrieved code data is then stored in the second memory at successive addresses generated by an address generator of the first electronic device.

The first electronic device preferably includes a verification unit which is part of the data processing unit 24. The verification unit compares received code data with the code data stored in the second memory 18, in order to avoid that the same code data are stored twice. For this purpose, the verification unit is connected to the second memory 18 and to the interface 19, where the code data signal is input.

Figure 6:
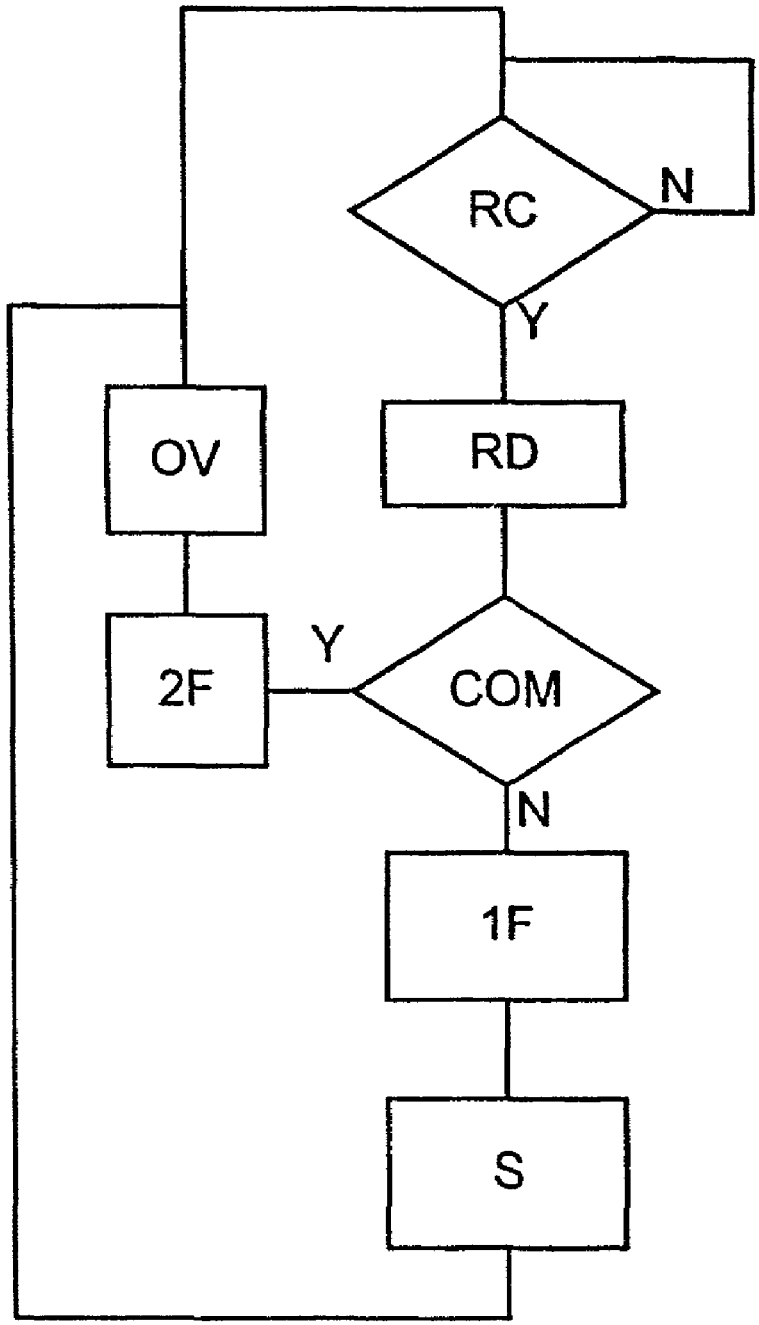
FIG. 6 shows a flowchart illustrating the operation of the first electronic device upon receipt of a code data signal.

Upon receipt (RC, see FIG. 6) of a code data signal by the interface 19, the verification unit reads (RD) the stored code data and compares (COM) the received code data with the code data stored in the second memory. If the received code data is already present or is not yet present in the second memory 18, the verification unit generates a second (2F) or a first (1F) flag, respectively. Under control of the first flag, the received code data is stored (S) in the second memory, whereas under control of the second flag, the received code data is ignored (OV) and access to the second memory is inhibited.

If the verification unit detects that the code data is already present, it may also verify whether the received code data is an updated version of the stored code data and, if this is the case, replace the stored code data with the updated code data. Thus, the contents of the second memory can be kept up-to-date. A user who reloads the first memory 16 in the remote control device 1, will then always have an updated contents.

The present invention provides not only a possibility to load or reload the first memory but, if the code data are available from a common source, such as, a CATV provider or an Internet provider, also a possibility to complete or update the first memory of the remote control device 1.

When the user now needs to update his/her remote control device 1 or to reload the first memory 16 of his/her remote control device 1, for example, because the contents has been lost due to a battery failure, he/she can download the code data from the second memory. For this purpose, the user activates his/her remote control device 1 by pressing a call key associated with the first electronic device 5. This causes a calling signal to be generated and transmitted to the first electronic device 5. Upon receipt of such a calling signal, the first electronic device 5 will start to address the second memory 18 to download the code data from the second memory 18. Depending on the configuration of the remote control device 1, different code data will then be transmitted to the remote control device 1, where they can be stored in the first memory 16. This is effected either by means of the transmitters/receivers 15 and 20 or the wired connection, if available.

The invention claimed is:

1. A arrangement including a remote control device and at least one further electronic device, said remote control device comprising a first memory for storing a set of code data for use in controlling said at least one further electronic device, said remote control device further comprising a signal generator having an input for receiving code data from said first memory, said signal generator generating, on the basis of said code data, control signals for controlling said at least one further electronic device, and transmitting said control signals to a control signal input of said at least one further electronic device, characterized in that said at least one further electronic device includes a first electronic device having a data input for receiving data from said remote control device, and said remote control device further comprises a code data output unit connected to said first memory, said code data output unit having a further input for receiving an upload signal, said code data output unit reading, under control of said upload signal, at least a subset of said set of code data from said memory, transmitting said subset of said set of code data burst-wise to the data input of said first electronic device, said first electronic device including a second memory for storing said received subset of said set of code data.

2. The arrangement as claimed in claim 1, characterized in that said signal generator is connected to said code data output unit, said code data output unit generating a control signal after reading said subset of said set of code data, and transmitting said control signal and said subset of said set of code data to said signal generator, said signal generator generating a code data signal, including said subset of said set of code data, upon receipt of said control signal, and transmitting said code data signal to said data input of the first electronic device, said first electronic device including a signal decoder for retrieving said subset of said set of code data from the received code data signal.

3. The arrangement as claimed in claim 1, characterized in that said first electronic device further comprises a verification unit connected to said second memory and said data input, said verification unit comparing a received subset with subsets stored in said second memory, and generating a first flag if said received subset is not stored in said second memory.

4. The arrangement as claimed in claim 3, characterized in that said verification unit generates a second flag if said received subset is already stored in said second memory, said verification unit further inhibiting, under control of said second flag, storage of said received subset in said second memory.

5. The arrangement as claimed in claim 1, characterized in that said signal generator generates said control signals in accordance with a predetermined transmission protocol, and said code data output unit includes an identifier, identifying said transmission protocol, into said subset.

6. A remote control device comprising;

a first memory for storing a set of code data for use in controlling at least one further electronic device;

a signal generator having an input coupled to said first memory for receiving said code data, said signal generator generating, on the basis of said code data, control signals for controlling said at least one further electronic device, and transmitting said control signals to said at least one further electronic device; and a code data output unit connected to said first memory, said code data output unit having a further input for receiving an upload signal, said code data output unit reading, under control of said upload signal, at least a subset of said set of code data from said memory, and transmitting said subset of said set of code data burstwise to a data input of a first electronic device of said at least one further electronic device.

7. The remote control device as claimed in claim 6, characterized in that said remote control device is a user-configurable remote control device.

* * * * *